United States Patent [19]

Feder

[11] Patent Number: 4,490,411

[45] Date of Patent: Dec. 25, 1984

[54] APPARATUS FOR AND METHOD OF METALIZING INTERNAL SURFACES OF METAL BODIES SUCH AS TUBES AND PIPES

[76] Inventor: Darryl Feder, 3134 Maple Leaf Dr., Glenview, Ill. 60025

[21] Appl. No.: 475,383

[22] Filed: Mar. 14, 1983

[51] Int. Cl.[3] ..... B05D 7/22; B05D 3/02

[52] U.S. Cl. ..... 427/46; 427/182; 427/183; 427/233; 427/234; 118/306

[58] Field of Search ..... 427/233, 234, 46, 182, 427/183, 318; 118/306

[56] References Cited

U.S. PATENT DOCUMENTS

| | | | |
|---|---|---|---|
| 2,803,559 | 8/1957 | Rutherford et al. | 427/46 |
| 3,007,810 | 11/1961 | Hobrock | 427/233 |
| 3,814,616 | 6/1974 | Kondo et al. | 427/183 |
| 3,974,306 | 8/1976 | Inamora et al. | 427/233 |
| 4,197,336 | 4/1980 | Savchenko et al. | 427/234 |
| 4,243,699 | 1/1981 | Gibson | 427/183 |
| 4,302,482 | 11/1981 | Heck | 427/34 |

*Primary Examiner*—John E. Kittle
*Assistant Examiner*—James J. Seidleck
*Attorney, Agent, or Firm*—Norman Lettvin

[57] ABSTRACT

An apparatus and method for metalizing the interior of pipes or tubes is disclosed. The base metal pipe or tube to be internally metalized is moved axially while simultaneously being rotated at a relatively high rpm. A first pre-heat means, preferably an induction heating means, heats a portion of the pipe and its interior to a first elevated temperature, and particles of the metalizing material are deposited into the interior of the pipe to be heated to said first elevated temperature. The rotation of the pipe distributes the fluidized particles into laminae which, under the further influence of centrifugal forces, automatically distributes the semi-fluidized particles effectively. The fluidized metalizing material is bonded together and to the body substrate by application of a second induction heat at a higher heat level or temperature at which bonding occurs between the laminae of metalizing material and between the metalizing material and the base material of the tube or pipe. Preferably the process is performed in the presence of a non-oxidizing gas such as pre-heated nitrogen. Various means for delivering the metalizing powder to the interior of the pipe are disclosed.

9 Claims, 5 Drawing Figures

APPARATUS FOR AND METHOD OF METALIZING INTERNAL SURFACES OF METAL BODIES SUCH AS TUBES AND PIPES

FIELD OF THE INVENTION

This application is related to my co-pending application, Ser. No. 374,283, filed May 3, 1982.

This invention relates to the metalizing of the interior of tubular metal bodies, such as pipes and tubes, so as to produce interiorly metalized articles, such as chrome plated pipes, tubes, and segments thereof, for such ultimate uses as interiorly protected pipes, tubes, bearing, sleeves or collars.

BACKGROUND OF THE INVENTION

There are many fields of manufacture in which the metalizing of the interior of base bodies, such as pipes and tubes, or segments thereof, of ordinary metals or steel, with an expensive surface layer treatment, or coating, that is fused to the metal, is desirable to provide a finished, or partly finished, part or product that will respond to manufacturing specifications, but which is less expensive than making the entire body of the same material that the specifications require. Thus, parts such as the interior of pipes or tubes, used to convey therethrough corrosive or abrasive fluids, liquids, slurries and the like, and bearings, sleeve segments, or collars are frequently required to provide thereon an interior, or concaved, metalized surface of chromium, or chrome, or other special metal or metal alloy, that will either resist wear or will provide a good bearing surface. For instance, in strings of pipe used in deep oil wells, it is desirable that the interior surface of the pipe have resistance to corrosion or wear, so as to extend the time period that a string of pipe functions without disruption of oil production and consequent increase of costs.

It has been long known that ordinary steels, except for leaded steels or resulphurized steels, may be chrome surfaced, by plating or the like, to both meet the specifications for desired strength of the part and with the surface character being specially adapted for exposure to a harsh environment in which the part is to be used.

However, chromium, for example, is a relatively expensive material, and chromium's use in various chemical baths means, by which chrome plating may be effected, is enviromentally undesirable and/or difficult and expensive to control. Also, it is technically difficult to deposit a metalizing layer of any substantial thickness onto the interior surface of tubes or pipes, or segments thereof, that are to serve as the bearing surface of a bearing or journal element.

While metalizing the exterior surface of bars and rods avoids, to substantial extent, the undesirable environmental effects associated with chemical plating of such bodies, the mechanical metalizing techniques previously employed in metalizing such bars and rods have usually used an open flame torch that burns fuel gases, such as acetylene, propane, or the like in the presence of oxygen, to both preheat the body surface to an elevated temperature and to heat the surface application material, which is initally in powder form, to a temperature at which the powder material will become at least partially molten and fuse onto the base material of the body. These prior art metalizing techniques have not been wholly successful for economically metalizing the exterior of tubes, as the heat of a torch will frequently burn through the wall of the tube. It will be understood that such prior art metalizing techniques generally are not successful in metalizing the interior of elongated tubes and pipes, as access to the interior of such elongated bodies with an open flame torch is very difficult, if at all possible.

The problems with said prior technique for metalizing exterior surfaces are that there is both lack of accurate control of the thickness of the layer of the surface application material to the underlying body, and resultant lack of uniformity of the thickness of the layer that is applied by open torch heat. Furthermore, the minimum thickness of the layer of applied material usually obtained by metalizing with an open flame torch, working with powdered metal, is about 0.008 inches, and maximum thickness of layer of applied metal is about 0.015 inches, both of which thickness values are frequently much greater than the thickness of the applied material layer required to be supplied to meet the performance specifications for the metalized part, and this substantially increases the cost of manufacture. A further problem is that when using fine particles of metalizing materials to form a fused surface on an underlying body, the torch heat intensity is frequently so great that it vaporizes, or burns away, a substantial quantity of the finest particles of the metalizing material, resulting in loss of material and economic waste. Still another problem is that, in the event a thick layer of metalizing is required to be deposited, there is insufficient control over the thickness of metal being deposited, and therefore maintaining of concentricity of the inner surface of a metalized sleeve, or journal is difficult, and machining or other expensive finishing operations must be resorted to in order to obtain a high degree of concentricity of the innermost surface of an arcuate part that has been metalized.

An improved method of metalizing the exterior of metal bodies is disclosed in my co-pending application, Ser. No. 374,282, filed May 3, 1982. This application is directed to the much more difficult problem of metalizing the interior of tubular metal bodies, such as pipes or tubes, and to obtaining a high degree of concentricity of the innermost surface of the metalized deposit on the base body.

One search for prior art relating to concepts disclosed herein has resulted in noting the following U.S. Pat. Nos. Group A. Re. 24,852; 3,158,499; 3,359,943; 4,122,798; 4,197,336; 4,243,699; 4,302,482.

Other searches have disclosed the following U.S. Pat. Nos. Group B. 2,198,254; 2,241,095; 2,289,658; 3,278,331; 4,244,985; 4,324,818; 2,803,559; 2,887,984; 3,108,022; 3,326,177; 3,389,010; 3,560,239; 3,599,603; 3,922,384; 4,082,869; 4,315,883; 2,822,291; 2,845,336; 3,063,860; 3,207,618; 3,218,184; 3,394,450; 3,405,000; 3,532,531; 3,654,895; 3,814,616; 3,974,306; 3,982,050; and 4,169,906.

In Applicant's view, the prior art references of "Group A" are significant as they reflect attempts by others to effect deposition of a protective coating, sometimes metal, on the inner surface of an annular or tubular base member. Other of the prior art patents noted may have some relevance in connection with some of the broad concepts of application of powdered surfacing materials, including alloys, or in connection with the broad concept of metalizing less expensive base materials with a more expensive material. All references known to Applicant are called to the Patent Office's attention to reflect the state of the art, and to advise of Applicant's present knowledge of prior art that was considered by an employed searcher to be worthy of selection. In Applicant's view no single prior art reference, nor any logical combination of multiple prior art references would suggest, to one skilled in the art, the developments and improvements that Applicant discloses herein.

SUMMARY OF THE INVENTION

One object of this invention is to provide an improved method for metalizing the interior surface of metal pipes and tubes.

Another object of this invention is to provide an improved method of creating a novel and improved product, and the improved product itself, wherein the product is a sleeve, or segment of a sleeve, consisting of a tube or pipe of a base metal with an interior annulus of expensive metal or metal alloy laminated to the inside of the original tube or pipe to metalize the pipe.

A further object this invention is to provide an internally metalized tube or pipe wherein the thickness of the metalized layer, may be made to almost any desired thickness and may be accurately controlled so as to provide an innermost surface of very precise and concentric nature.

Another object of this invention is to provide an improved apparatus for, and method of, metalizing the interior surface of hollow, or tubular, bodies with a metalizing powder in a manner that substantially reduces burn-up, or burn-away loss, of the metalizing powder material.

A further object of this invention is to provide an apparatus and method for metalizing the interior surface of base metal tubular bodies with relatively expensive metalizing alloys or materials, such as chrome powder, in a manner to provide an accurate control of the thickness of the metalizing layer applied, while simultaneously avoiding economic loss of the metalizing powder through undesired vaporization or burning away of the powder material.

Still another object of this inventions is to provide a new and inexpensive method of forming a sleeve journal or bearing.

And still another object of this invention is to use the effects of both tangential drag imparted by the inner surface of the rotating tube or pipe, and centrifugal force, upon powdered metalizing material that has been changed by heat into at least semi-molten, or fluidized, form, to achieve a metalized surface that is laminated onto the interior of a tubular member, and that is characterized by one or more of the following advantageous features: surprisingly and unusual uniformity of the inner surface concentricity of the layer deposited despite substantial thickness of the deposited layer; unusual hardness of the deposited metalizing layer; excellent bond between the metalizing layer and the base tubular body or substrate; and improved concentricity of the innermost surface of the metalizing layer as compared with the interior periphery of the base tube onto which the metalizing layer is deposited.

Further objects and advantages will become known to one skilled in the art, as these specifications proceed to describe the inventions disclosed herein.

In the instant invention, a first induction heating coil is used to provide, as part of a first step, the heating of a portion of an axially moving and rapidly rotating tubular body, such as a pipe or tube, to a first selected pre-heat temperature, then introducing into the preheated, rotating, first tube portion a powdered metalizing material that partakes of the pre-heat and becomes at least semi-molten or fluidized, to the end that the rotating tube applies a tangential, or shear, force to the fluidized material causing development of spiral lamination within the body of fluidized material, and in a manner so that the radially outermost layer, or lamina, of fluidized particles of metalizing material adheres, to the inner, generally cylindrical, surface of the tubular body, and with the other and additional spiral or substantially cylindrical, laminae of molten or semi-molten particles of metalizing material operating to tend to move outwardly against adjacent outer laminae of molten or semi-molten particles, under centrifugal force deriving from the rapidly rotating tubular body and it contents, so as to effectively create a compacted sleeve, or annular layer, of metalizing material adjacent the inner cylindrical surface of the body; and then fusing the molten, compacted, metalizing material layer to the body by a second induction heating of the tubular body with the metalizing material adhering thereto, at an elevated fusing temperature, by using a second induction heating coil to heat the tube and its contents, all in the presence of an inert gas which substantially precludes oxidation of the metalizing material.

In the course of such metalizing, the powdered metalizing material becomes at least semi-fluidized, being molten or semi-molten, so that as the tubular body is rotated, preferably at a relatively high rpm, the semi-fluidized metalizing material, under centrifugal force, acts to apply substantial pressure onto outer, or surrounding, lamina of the metalizing layer, including the lamina that lies immediately adjacent the tubular body, thereby contributing to and effecting compacting of the metalizing material and excellent adhesion of an annulus of metalizing material to the base metal of the tubular body when the metalized body is cooled, and simultaneously contributing to a fluidized concentricity of the radial innermost surface of the metalizing material that, when solidified and measured, reflects that the innermost concave surface of the metalized layer is unexpectedly more accurately centered and concentric relative to the axis of rotation than the original concentricity of the base tube which is being metalized.

DETAILED DESCRIPTION OF THE DRAWINGS

Figure 1:
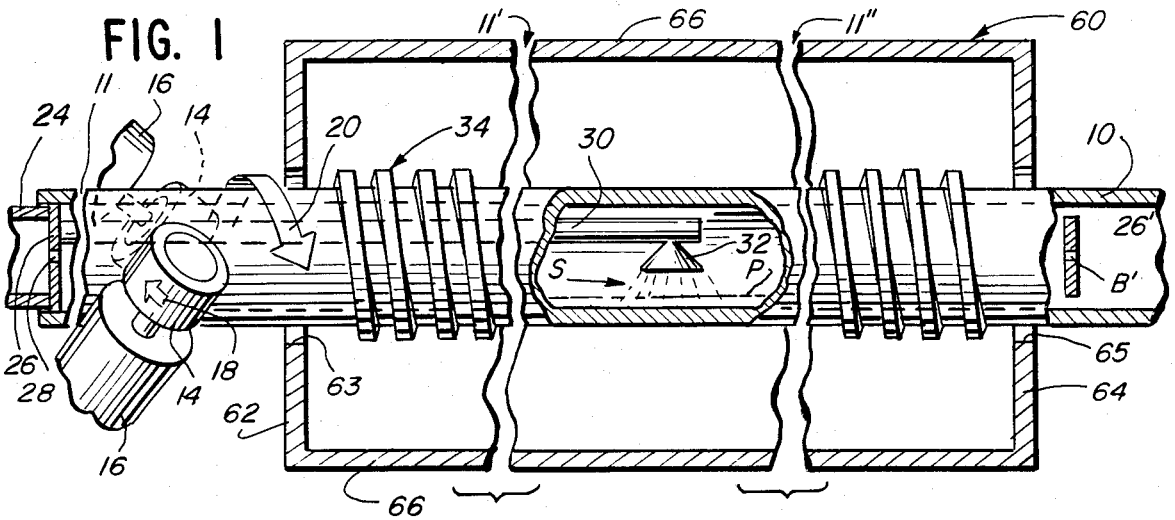
FIG. 1 is a partial side elevational and cross-sectional view, with portions broken away for clarity, showing one form of my apparatus for metalizing the interior of a tube or pipe.

Referring now to the drawings, FIG. 1 shows in vertical, cross-sectional view, one form of apparatus for practice of the invention upon a length of steel pipe, or tube, 10.

As seen in FIG. 1, the pipe or tube 10 may have a substantial length, as suggested by the indefinite-length break illustrated at 11. A portion of the pipe is both supported and rotated by a pipe-rotating means 12 that is well known in the art. Although only one set of rotating means 12 is shown adjacent the left hand end of FIG. 1, it is understood that similar support and rolling means are to be provided at the right hand end of FIG. 1, but these have been omitted from the drawing as they will be understood from the following description of means 12. The means 12 includes a pair of pipe engaging drive rollers 14, located on opposite sides of pipe 10 and frictionally engaging pipe 10 and being located in part below the mid-height of pipe 10 so that the rollers'engagement with pipe 10 also serves as a support. The rollers 14 are driven by any convenient or well-known means, such as electric drive motors 16, by means of which high speed and selective control of speed may be effected as well-known in the art. The direction of rotation of the drive rollers, indicated by arrow 18, brings about rotation of pipe 10, and simultaneous axial movement of pipe 10 as indicated generally by the spiral, or helical, arrow 20 shown associated with pipe 10.

Since a substantial length of pipe or tube 10, hereinafter also "pipe/tube", is to have its interior surface metalized, the pipe 10 is first arranged in a telescoping relation to an elongated internal spindel or mandrel means 22, shown only in fragment in FIG. 1. The mandrel can be made of as great an axial length as desired, or necessary, depending upon the length of pipe 10 that is to be metalized, with the only limitation being that the maximum diameter of mandrel means 22 is less than the diameter of the pipe/tube's lumen, or bore, so as to permit easy telescoping of pipe 10 thereonto.

The mandrel means 22 is shown in the form of an elongated tube, or pipe, 24 whose end most proximate the left hand end of a metalizing station shown in FIG. 1, includes an annular transverse end wall 26 with a centrally located opening 28 therethrough.

Figure 2:
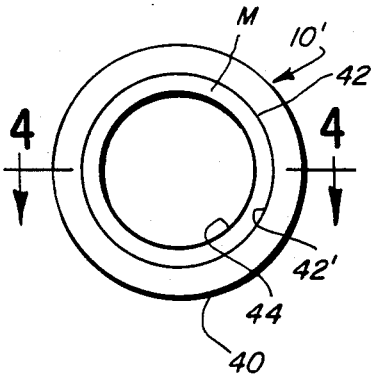
FIG. 2 is a side elevational view of an axial segment of a pipe or tube that has been metalized by the apparatus shown in FIG. 1.
Figure 4:
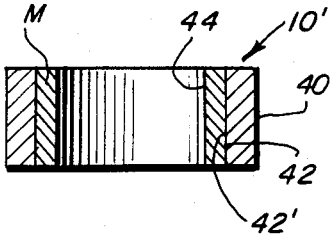
FIG. 4 is a cross-sectional view of the segment of FIGS. 2 and 3, taken substantially on line 4—4 of FIG. 3.

FIG. 1 indicates that the right hand end of pipe 10 may have a similar telescoping relation with a right hand support, or mandrel (not shown), the suggestion being by way of the indication of the presence of a downstream, transverse, end wall 26', whose peripheral dimension is such as to clear the inner periphery of the pipe 10 and any metalizing layer M that has been applied to said inner periphery of the pipe as seen in FIGS. 2 and 4. The downstream end wall 26° may be provided along its outer circular periphery with a flexible skirt, or flange, that inhibits backflow of reduced-temperature gas or of air upstream of wall 26°, or permits pressurized gas to empty therepast downstream, or may be provided with a center bore 28° as needed, to permit downstream escape of pressurized gas therethrough.

As shown in FIG. 1, there is projecting within the lumen of pipe 10, a cantilevered boom, or supply-support tube, 30 through which metalizing powder, entrained in a stream that includes a pressurized, non-oxidizing, gas, is delivered in the form of a spray or shower S from a nozzle 32 in the interior of pipe 10 at a station located laterally, or axially of pipe 10, between two electrical, induction heating, coil means, namely a first such induction heating means 34 and a second induction heating means 36.

While the region into which the spray of metalizing powder is shown between heating means 34 and 36, it may be found preferable to discharge the spray S closer to first heating means 32 but still between means 34 and 36, or alternatively, even upstream of or in the plane of the first heating means 34, rather than downstream of means 34 as shown.

The first induction heating means 34 is in the form of a helical coil and is arranged, constructed, and positioned relative to pipe 10 so as to heat the portion of the pipe or tube, hereinafter also pipe/tube, that is surrounded by coil 34 to a first elevated temperature, so that not only the adjacent surrounded segment of pipe/-tube 10, but also the interior of pipe/tube 10 and its contents partakes of said first elevated temperature. The heat delivered and maintained adjacent first induction heating means 34 is adopted to cause the metalizing powder, after it leaves nozzle 32, to become molten, or semi-molten, so as to in effect convert the powdered metalizing material into a fluidized bed, or pool-like layer, of metalizing material.

In my experimentation with the invention herein disclosed, I made efforts to look into the lumen or interior of the pipe when it was not rotating but after the metalizing powder had been subjected to the pre-heat of coil heating means 34, and it appeared to be that there was a pool of fluidized, or at least semi-molten, metalizing material lying in the lowermost portion of pipe 10.

The spray S from nozzle 32 should preferably be pre-heated, to a temperature approximating the pre-heated temperature developed by coil means 34, by the heated non-oxidizing carrier, or entraining, gas that is pumped under pressure through supply-support tube 30 and nozzle 32, although in the experiment described hereinafter, the nitrogen was not pre-heated. I have preferred using nitrogen gas as the non-oxidizing carrier gas, but other non-oxidizing gases, such as any of the series of rare gases, such as neon, argon, etc., could be used, the gas serving primarily as a non-oxidizing fluid carrier for moving the metalizing material particles from a supply (not shown) through tube 30 and nozzle 32 to a point where the metalizing material will perform as disclosed herein. The end of supply-support tube 30, that is shown connected to end wall 26, may be fed by a separate tube (not shown), or may open to the interior of tube 24 which could serve as a supply conduit for supplying support tube 30 with a flow of gas-entrained metalizing particles. In the latter alternative, the central opening 28 in end wall 26 serves as an additional means for supplying, to the interior of pipe 10, a flow of metalizing particles entrained in a non-oxidizing gas.

The spray of metalizing particles S from spray nozzle 32, and the entrained gas and metalizing particles entering pipe 10 through opening 28 in end plate 26, is converted by the induction heat from first coil 34, to at least a semi-molten state, thereby providing a pool, P, or fluidized bed, of metalizing powder in the pipe 10.

The pipe 10 is to be rotated at a relatively high rpm. Therefore, the pool, or fluidized bed, of the deposited powder, at least in a semi-molten state, is then subjected to two forces that have been known to occur in classical fluid flow systems. The inner wall surface of the rotating pipe 10 develops a tangential drag force on the fluidized particles immediately adjacent thereto, and because of the nature of the system, it is believed that a classical laminar flow is imparted to the rotating fluidized pool or bed, and thus operates to arrange the particles of at least semi-molten metalizing material into either a spiral, or substantially concentric laminae. At the same time the centrifugal forces acting on each particle, whether it still be somewhat solid, or has become at least semi-molten, exist. If there are heavier particles, or particles of greater mass, there would be greater centrifugal force developed on that particle than on lighter, or smaller-mass, particles.

In any event, the forces developed, and the arrangement of laminae, is believed to be such that the greater mass, or heavier, particles move radially outwardly, and the lighter particles and impurities are thereby displaced and forced radially inwardly of the annular band of laminae of the fluidized bed. At the same time, the centrifugal force, and, it is believed, the said development of substantially concentric laminae of at least semi-molten metalizing material, cooperate to cause the following to occur: the greater mass, or larger and heavier, particles are forced radially outwardly against the inner surface of pipe 10; the smaller mass, or lighter, particles of metalizing material and impurities are thereby displaced radially inwardly of the fluidized bed; and the innermost surface of the fluidized bed or annulus, through the combination of forces, is automatically forced to adopt a concentricity, or circularity, that is most precisely centered about the axis of rotation of the pipe.

At the same time that the foregoing is occurring and is being accomplished, the pipe and fluidized bed therein is, as shown in FIG. 1, moving to the right where it is then subjected to a second, and higher, temperature developed by induction heating coil 36. This second temperature is substantially higher than the first temperature at which the metalizing particles are made at least semi-molten, or fully molten, and the nature of the fluidized material is such that at the higher temperature the fluidized metalizing material fuses into an annulus, with the outermost lamina fusing to the inner wall of pipe 10 and the other laminae fusing to adjacent laminae. Thereafter, cooling of pipe/tube 10 at it leaves the region of heating coil 36, passing to the right as seen in FIG. 1, operates to solidify the metalizing material into a hardened annulus, whose innermost surface is substantially precisely centered about the axis of rotation of pipe 10.

Figure 3:
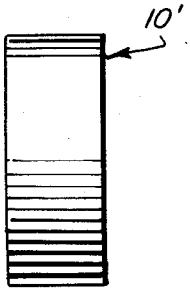
FIG. 3 is an end elevational view of the metalized tube segment shown in FIG. 2, and is taken looking at the tube segment from the left of FIG. 2.

FIGS. 2–4 illustrate a product that has been produced by the process and apparatus as disclosed in FIG. 1. After the inside of a pipe 10 had been metalized and cooled, the pipe was sliced, or cut transversely to the pipe's axis, to provide an annular member 10' as shown in FIGS. 2–4. The segment 10' the original pipe 10 that was treated as described hereinabove, with certain additional details set out hereinafter, was found to have on the inner periphery thereof, an annular layer of metalizing material deposited thereon. The pipe segment 10' has an outer periphery 40, and an original inner periphery 42. The annulus of metalizing material M has an outer periphery 42' which is fused to and is bonded tightly to the pipe's inner periphery 42. The inner periphery of the layer of metalizing material is designated 44.

A light machining operation on the inner periphery 44 will operate to reduce and polish off any impurities or irregularities that will have solidified at said inner periphery 44. The ring member 46 seen in FIGS. 2–4 can then be used as a bearing, or bearing sleeve. If cut through diametrically, and polished at the cut faces, the annular product would then provide two open sided, semi-cylindrical, journals, or bearing pillows, for a shaft, or the like.

While in FIG. 1 I have shown use of a supply-support tube 30 with a nozzle at the extended end, in the experiments actually performed I used a $\frac{1}{8}$ inch copper tube with a standard bore that was shaped to provide a length of supply tube corresponding in length and position within the pipe 10 as indicated by tube 30, and the extended end of the copper tube was bent to project downwardly so that the open end of the copper tube served as a discharge nozzle as diagramatically illustrated by nozzle 32. The nitrogen was under pressure of 80 p.s.i., and was not pre-heated. The size of the metalizing particles was variable, and it was a powder secured by purchase from Colmonoy Corporation of Detroit, Michigan, whose powdered metal and metal alloy materials are known by the name "Colmonoy". The powder used was No. 63 Colmonoy, with a melting point of 1875° F. (1025° C.) and having a Rockwell hardness (C Scale) of 58–63 and a specific gravity of 7.8. Other alloy numbers available from Colmonoy have greater values and higher melting point temperatures to a maximum of about 2250° F. The average particle size of the No. 63 Colmonoy was 250–325 microns.

The pipe/tube 10 had an O.D., 40, of $1\frac{5}{8}$" and I.D., 42, of $1\frac{1}{4}$", so that the wall thickness was about 3/16". The average thickness of the deposited metalizing layer was $\frac{1}{8}$". The pipe/tube 10 was rotated at 1750 rpm, and its axial speed was about 3 feet per minute. The I.D. of the metalized tube, 44, had a dimension slightly less than 1".

With respect to the use of pressurized, non-oxidizing gas to entrain and move the metalizing particles through tube 30 and nozzle 32, it will be understood that as the pressurized gas escapes, or discharges, through the limited size orifice of nozzle 32 to the greater diameter interior of pipe 10, the gas expands and thereby absorbs heat locally, thereby providing a cooling effect locally at nozzle 32 which, through conduction affects some length of nozzle 32 and its associated tube 30. This local cooling does not adversely affect the induction heating of pipe 10 from first heating coil 34, but it served to keep the copper tube that I used at a reasonable temperature without adversely affecting the flow of metalizing material therethrough or therefrom.

The powdered material comes from the manufacturer in fluxed condition. When the particles of powder become molten, the pure alloy is forced by centrifugal force outwardly toward the pipe 10, and the slag that includes flux is forced by displacement to the inner surface 44 of the metalizing layer.

The coating in the finished product of FIGS. 2–4 was found to be very dense and very hard. In cutting transversely through the metalized tube, to secure the segment shown in FIGS. 2–4, the outer pipe of 4140 steel was easily cut through with a metallurgical abrasive saw, but the saw stalled when it encountered the annulus of metalizing material. The Rockwell hardness of the desposited metalizing material provided a reading of 56–58.

A measurement of concentricity of the I.D. of the metalizing ring reflected all points to be within 0.001 inches from the center of the body, while measurement of concentricity of the inner wall of original pipe/tube 10 reflected that concentricity varied by about 0.005 inches.

Additional sample base metal tubes that were internally coated by the method described above with respect to FIG. 1, and which then had a cross-section of the general type shown in FIG. 4 but with different dimensions, were tested and reported upon to me by third persons. The samples provided included a nickel base alloy metalizing Colmonoy powder bonded to the I.D. of standard tubing made by Lone Star Steel Company, having a 1.563" 0.D. × 1.000" I.D., Grade C-1020. The hardness of the original tube was 74 RB at the tube I.D. and 66 RB at the tube 0.D. The hardness of the bonded material was 56 RC at the I.D. The significant results of examination was that the metallurgical bond of the dissimilar materials was smooth and quite strong. Air hammer fracturing of samples failed to separate the layers and produced only radial cracking.

In another test which sought to compress or shear the metalizing coating M from the base tube, the results of tests of three samples led to the conclusion that the base metal tube sheared out, but not the interface between the metalizing coating and the base metal tube, and reflects that the metalization is bonded soundly to the base material tube with no evidence of holes or separation at the interface.

In the forming of the various samples discussed above, the coil means 34 was a 4- turn coil with an internal diameter (I.D.) of the $1\frac{7}{8}$", designed to provide a pre-heating of the portion of pipe/tube 10 surrounded by coil means 34, and also its interior, to an initial temperature of about 900° F. The second heating coil means 36 was designed to provide an induction heating of the portion surrounded thereby to a chrome-fusing temperature of approximately 1800° F. or more, as required, using a 6-turn coil with a $1\frac{3}{4}$" I.D. The power consumed by the two heating coil means 34 and 36 is about 100 kilowatts at a frequency of 10 khz. The temperature developed by an induction heater is a function of the number of turns of the coil heater and its closeness to the body being heated.

In the apparatus disclosed, the outer diameter of the downstream end wall 26' is selected to be such as to accommodate passage of the annulus of metalizing material M therepast. The wall 26' may be supported from a structure (not shown) similar to the pipe structure 24 shown at the left of FIG. 1.

In one alternate form of construction, the two end walls 26 and 26' may serve as anchors, or supports, for the ends of an elongated support bar (not shown) that bridges the space between end walls 26 and 26', and the tube for delivering the powdered metalizing material at its point of discharge, upstream of coil 36', or such as at the position illustrated by the location of spray nozzle 32 in FIG. 1, can be supported from the support bar. This arrangement would provide flexibility to the means for locating the discharge nozzle 32, or its equivalent, at any desired location along the support bar as disclosed in this alternate form of construction.

Figure 5:
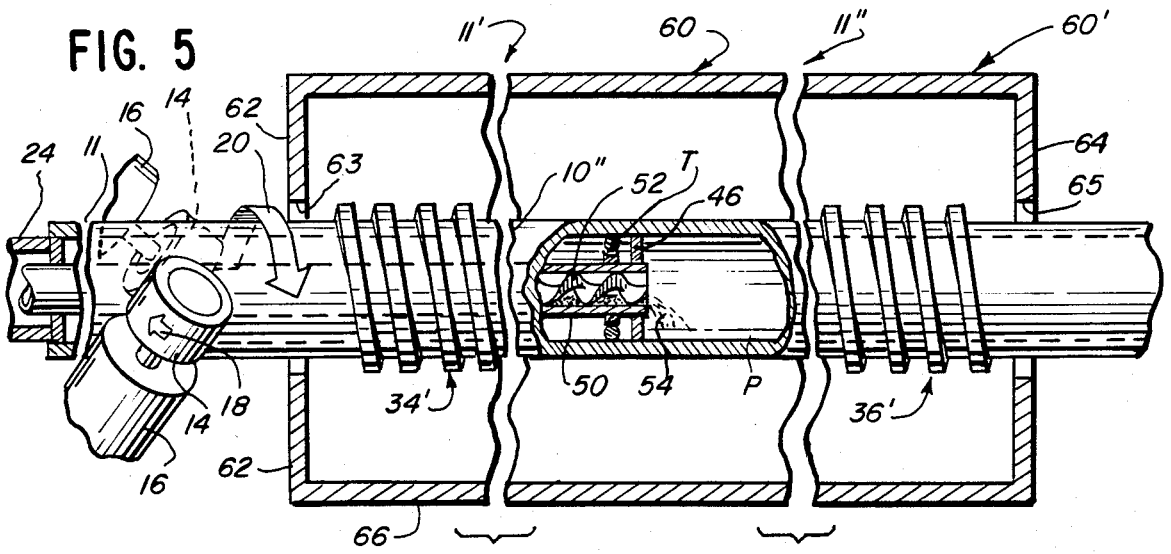
FIG. 5 is a view similar to FIG. 1, but showing an alternate form of apparatus for delivery of powdered metalizing material to the interior of the rotating pipe or tube that is to be metalized.

As a second alternate form of construction, FIG. 5 illustrates the use of an elongated auger tube and concentric auger for delivering metalizing powder to a desired point of discharge between first coil 34' and second coil 36'. The supply of metalizing powder is moved through an auger tube 50, whose length is indefinite as indicated by the upright break line 11'. A downstream break line 11"(shown in both FIGS. 1 and 5) indicates that the axial length of the pipe/tube and apparatus is indefinite, as it may be that the process herein described will be used with pipe/tube lengths of almost any size, considering that standard mill lengths could be of lengths up to 30 feet long or greater.

The auger tube could be supported at its left hand end by any appropriate means (not shown) and could have it right hand end provided with a trolley or roller support T, shielded by spaced end plates 46, which keeps the auger tube 50 centered within pipe/tube 10 and provides for rotation of the pipe/tube relative to the feed auger. An elongated auger member 52, as well known in the art, is concentric within tube 50 and can be caused to rotate at a preselected speed to deliver the desired amount of metalizing material 54, at a controllable rate to the portion of pipe/tube 10 located between heating coils 34'and 36'.

In the forms of apparatus disclosed in FIGS. 1 and 5, it is felt desirable to enclose the operative elements of the apparatus in a treating chamber which serves to confine and preserve the heat generated by the heaters, 34-36 of FIG. 1 or 34'-36' of FIG. 5, and which serves to isolate the portion of the tube/pipe 10 being acted upon by the heaters from the vagaries of drafts in a factory, and also serves as a protection for the apparatus.

Thus, a treating chamber 60 is provided comprising two laterally spaced end walls 62 and 64 and appropriate longitudinal walls 66 which serve to surrounded and enclose the interior of the treating chamber. The end walls 62 and 64 respectively have therein aligned first opening 63 and second opening 65 through which the pipe/tube 10 is caused to pass as it moves axially under the drive of rollers 14. In operation, a pipe/tube 10 to be treated has its leading, or first end, enter through first opening 63 moving axially, and being rotated by rollers 14 at high speed to be treated as described above, and then to have said first end move outwardly from the treating chamber 60 through second opening 65.

While I have disclosed herein an improved method of metalizing internal surfaces of metal bodies, persons skilled in that art will appreciate that the invention herein may be adapted and modified for related purposes, and it is intended to cover all aspects of my invention, herein, as limited solely in the claims appended hereto.

What is claimed and desired to be secured by Letters Patent of the United States is:

1. An apparatus for metalizing the interior of an elongated pipe or tube body comprising, in combination:

an elongated treating chamber;

a first opening in said treating chamber through which one end of an elongated pipe body, followed by the remainder of the pipe body is adapted to enter, moving axially of the body and through said elongated chamber;

a second opening in said treating chamber through which said one end of the elongated pipe body and the body, moving axially, is adapted to leave the treating chamber followed by the remainder of the pipe body;

the spacing between the first and second openings in said treating chamber being less than the length of the elongated pipe body being metalized;

means for moving said elongated pipe axially in only one direction through said first opening into the chamber, then through the chamber, and then from said chamber outwardly through said second opening, while simultaneously rotating the elongated pipe;

a first heating means positioned in the chamber for first locally pre-heating, to a first elevated temperature, the interior wall of a portion of the axially moving pipe, after it has passed through said first opening in the treating chamber;

a second heating means in the chamber, positioned spaced from said first heating means and in the direction toward said second opening of the treating chamber, and for locally heating an adjacent portion of the interior of the axially moving pipe to a second elevated temperature greater in degree of heat than said first elevated temperature;

a metalizing powder supply means arranged to discharge metalizing powder particles entrained in a non-oxidizing, pressurized, gas carrier into the locally pre-heated interior of said pipe, at a point within the pipe that is adjacent the location of the first heating means in the chamber to partake of the pre-heat developed within the pipe by said first heating means, the temperature developed by said first heating means being at a degree of heat where the metalizing powder particles become at least semi-fluidized; and the temperature of the second elevated temperature being selected to be that at which the semi-fluidized metalizing powder particles will fuse to the body and to each other, to provide a continuous sleeve of metalizing material adhering to the inner surface of the elongated pipe body.

2. An apparatus for internally metalizing an elongated pipe or tube body comprising, in combination:

means defining an enclosing metalizing chamber having a first opening through which a first end of the elongated body to be metalized is to enter the chamber, and a second opening through which the metalized elongated body is to exit from the chamber;

the spacing of said first and second openings of the metalizing chamber being less than the length of the elongated pipe body being metalized;

means operatively associated with said elongated body for axially advancing the elongated body only in one direction relative to said chamber while simultaneously rotating said body at a relatively high rpm about its longitudinal axis;

a first heating means positioned within said chamber for locally pre-heating a portion of the elongated body, and the hollow interior thereof adjacent said portion, after it enters the chamber, to a first elevated, selected, pre-heat temperature, as the elongated body advances through the chamber and past said first heating means;

means providing, within the hollow interior of the pipe or tube body that has been pre-heated to said first elevated temperature, for the discharge of an amount of a selected metalizing power in a mixture of particle sizes in the presence of only a pressurized, non-oxidizing gas, whereby to deposit, onto the inner wall of the body, metalizing particles of a nature that will become at least semi-fluidized at the pre-heat temperature; the tangential force transmitted by the rotating body and the centrifugal force developed on the semi-fluidized metalizing powder particles by the rotation of the pipe or tube being operative to develop within said hollow interior of the body a molten annulus of laminae of metalizing particles, which particles are further distributed radially outwardly of the axis of rotation of the body, by centrifugal force within a sleeve of fluidized metalized particles whose outermost cylindrical surface laminates the interior surface of the tube or pipe, and whose innermost cylindrical surface is forced, by a combination of centrifugal force and the resistance forces between laminae of fluidized particles, to assume a substantially uniform concentricity about the axis of rotation of the tube or pipe;

and a second heating means within said chamber, spaced axially of the body, in the direction from the first heating means toward the second opening in the metalizing chamber for locally heating said pipe and internal annulus of fluidized particles to a second temperature, higher than the pre-heat first temperature, at which the sleeve of fluidized laminae of metalizing meterial fuses together, and with the outermost lamina fusing to the inner wall of the body.

3. An apparatus for metalizing the interior of an axially moving, elongated pipe or tube body comprising, in combination:

a first induction heating means located outwardly of the pipe body but operatively associated with the pipe body for locally heating only a portion of the elongated pipe body to raise the temperature of said pipe body portion and its corresponding lumen section to a desired pre-heat temperature;

means for depositing within the lumen of the pipe body, adjacent said portion subject to the pre-heat created by said first heating means, a metalizing material, in particulate form, entrained only in a non-oxidizing, pressurized, gas carrier whereby the metalizing material within the lumen of the pipe body becomes at least semi-molten and fluidized when heated to the desired pre-heat temperature;

second induction heating means, spaced from said first induction heating means axially of said elongated pipe body and located relative to the axially moving elongated body so as to be in position to subject the pre-heated body portion to a higher local heating temperature at which the metalizing material will fuse and adhere to the inner wall of the pipe body;

and means for simultaneously rotating the elongated pipe body at a relatively high speed, to distribute the fluidized metalizing material radially outwardly of the center of rotation into an axially elongated annulus of laminae of metalizing material concentric with the axis of rotation of the pipe body and forced outwardly by centrifugal force against the inner wall of the pipe body, and means for moving the elongated pipe body axially, and in only one direction so as to move each portion of the elongated body, that is being metallized, in sequence first past the first heating means to pre-heat the pipe body and the powdered metalizing material therein, and then past the second heating means to fuse the laminae of fluidized metalizing material into an annulus that is fused to the interior of the elongated pipe body.

4. An apparatus as in claim 3 wherein the metalizing material is a powder that is delivered within the lumen of the pipe/tube under force from a pre-heated pressurized non-oxidizing gas.

5. An apparatus as in claim 3 wherein the metalizing material is delivered as a shower consisting of a mixture of metalizing powder particles and non-oxidizing gas that has been pre-heated.

6. An apparatus as in claim 3 wherein the shower of metalizing powder and non-oxidizing gas includes metalizing powder having a range of particle sizes, and wherein the gas is nitrogen; and the shower being directed to be discharged within the lumen of the pipe/-tube in a direction transverse to the axial movement of the pipe/tube along its longitudinal axis, as the pipe/-tube moves between the pre-heat means and the fusing-heat means.

7. An apparatus as in claim 3 wherein the first, pre-heat, heating means includes an electrical induction heating coil means positioned to surround the laterally moving elongated pipe/tube, and being of a length and power output to locally heat, by induction, the body and its adjacent lumen portion to a temperature of about 900 degrees F., at which temperature the metalizing powder becomes at least semi-fluidized.

8. An apparatus as in claim 7 wherein the second, fusing-heat, heating means includes an electrical induction heating coil means positioned to surround the laterally moving and rotating elongated tube or pipe body that has a lamina of fluidized metalizing material clinging thereto, and being of a length and power output to locally heat, by induction, the pipe/tube body and its contents to a fusing temperature of at least 1800 degrees F., at which the lamina of metalizing powder, that clings to the inner surface of the tube or pipe, fuses to the body to provide a continuous metalized inner surface for the tube or pipe.

9. A method for metalizing the lumen wall of a pipe or tube body comprising, in combination, the steps of:

advancing a pipe/tube body axially only unidirectionally past a first induction heating station at which the pipe/tube body and its lumen are pre-heated to a temperature at which metalizing material will be made at least semi-molten;

depositing in the lumen of the pipe/tube body a supply of powdered metalizing material, intrained in a non-oxidizing, pressurized, gas carrier, at a point where said pre-heat is operative to cause the powdered metalizing material to turn into a semi-fluidized bed of at least semi-molten metalizing material;

rotating the axially moving pipe/tube body at a high rpm to cause the semi-molten metalizing material to be subject to centrifugal force and to assume the shape of an annulus whose outer periphery is constrained by the inner periphery of the pipe/tube body and whose inner periphery is concentric with the axis of rotation of the pipe/tube body;

and then induction heating the pipe/tube body, with the annulus of semi-molten metalizing material in the lumen thereof, at a higher fusing temperature than the pre-heat temperature to fuse the metalizing material together and to fuse the outer surface of said annulus of metalizing material to the inner wall of the pipe/tube body.

* * * * *